United States Patent [19]

Berry

[11] 4,252,500

[45] Feb. 24, 1981

[54] TURBINE WITH ROTORS GEARED TOGETHER

[76] Inventor: Clyde F. Berry, R.F.D. 7, Box 169 C, Manchester, N.H. 03104

[21] Appl. No.: 88,369

[22] Filed: Oct. 26, 1979

Related U.S. Application Data

[63] Continuation-in-part of Ser. No. 866,491, Jan. 3, 1978, abandoned.

[51] Int. Cl.[3] ..... F01D 1/20; F01D 1/22

[52] U.S. Cl. ..... 415/64; 415/66; 415/68; 415/69

[58] Field of Search ..... 415/60, 64, 66–69

[56] References Cited

U.S. PATENT DOCUMENTS

| | | | |
|---|---|---|---|
| 475,957 | 5/1892 | Altham | 415/68 |
| 802,025 | 10/1905 | Wagner | 415/202 |
| 819,616 | 5/1906 | Stumpf | 415/202 |
| 910,170 | 1/1909 | Callan | 415/67 |
| 955,478 | 4/1910 | Seelye | 415/198.1 |
| 1,307,864 | 6/1919 | Jones | 415/65 |
| 2,276,695 | 3/1942 | Lavarello | 415/65 |
| 2,312,995 | 3/1943 | Anxionnaz et al. | 415/68 |
| 2,434,678 | 1/1948 | Szczeniowski | 415/69 |
| 2,624,173 | 1/1953 | Bloomberg | 415/67 |
| 3,328,961 | 7/1967 | Aschauer | 415/68 |
| 3,635,576 | 1/1972 | Wieckmann | 415/65 |

*Primary Examiner*—William L. Freeh

*Attorney, Agent, or Firm*—C. Yardley Chittick

[57] ABSTRACT

A steam turbine comprising a housing in which there are at least two rotors turning on a common axis in the same direction but at different speeds. The rotors are connected by gearing preferably located externally of the housing. In the preferred form, the faster rotating rotor is driven by steam from a first steam nozzle or nozzles. The adjacent slower rotating rotor is driven by steam from a second steam nozzle or nozzles. Specially arranged vanes on the slower rotor and fixed vanes on the housing enable the expanding steam to react between the first and second rotors and the second rotor and the housing to obtain the desired power output from the steam.

In a modification, the second rotor has ports therethrough which extend diagonally backward and outward from the interior side of the second rotor to the exterior side so that some of the steam from the first steam nozzle if of higher pressure can pass through the diagonal ports to engage the fixed vanes on the housing.

10 Claims, 9 Drawing Figures

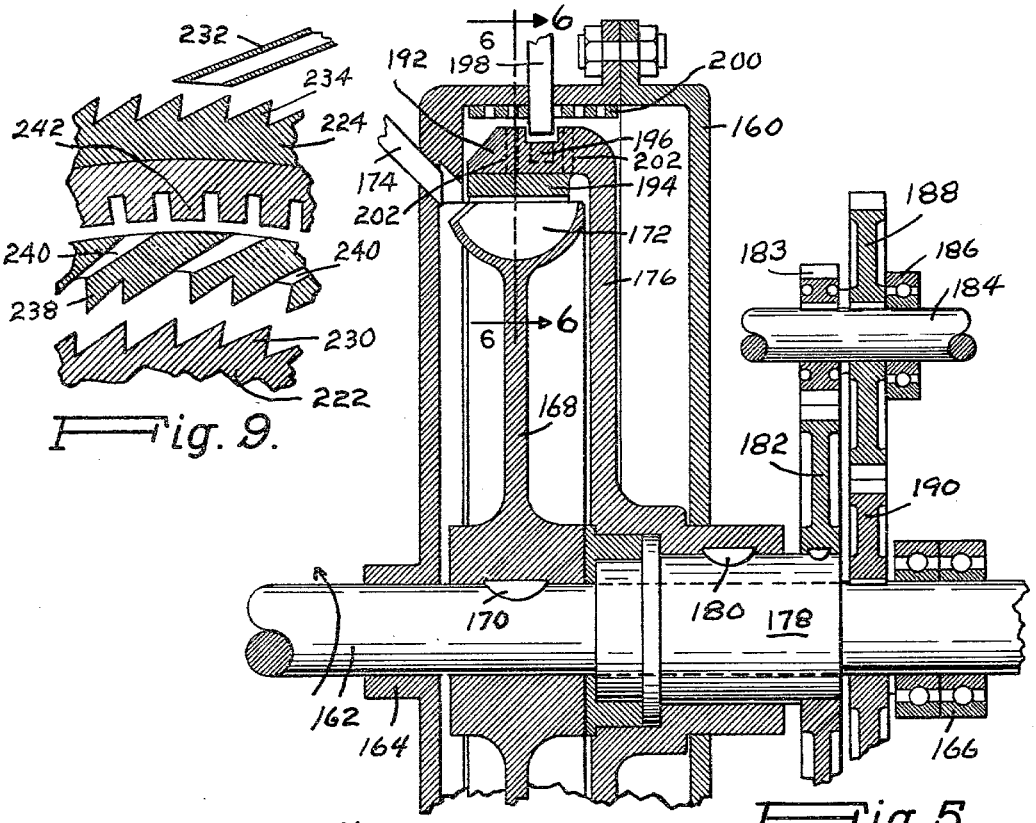
Fig. 9.
Fig. 5.
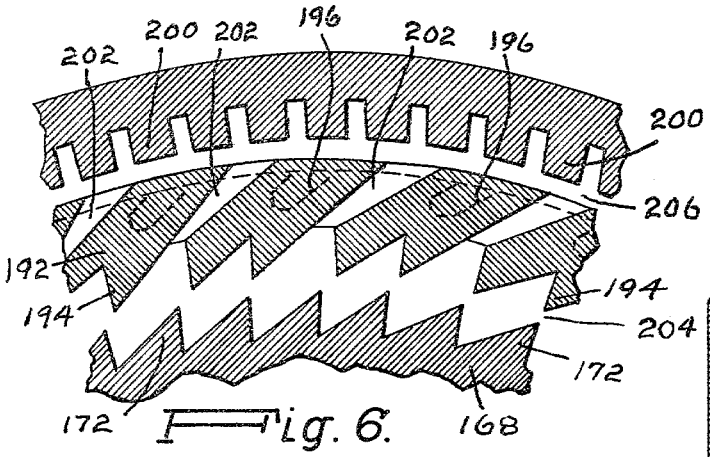
Fig. 6.
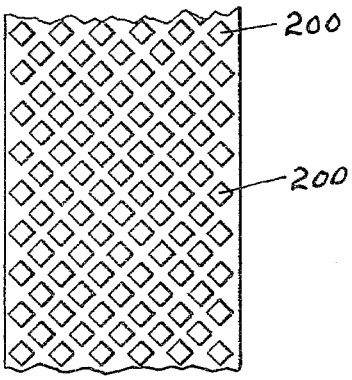
Fig. 7.
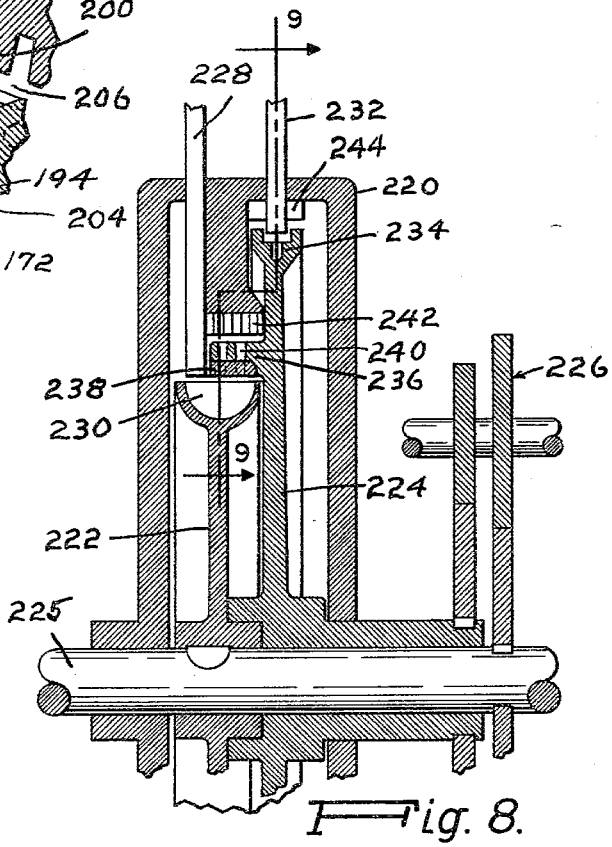
Fig. 8.

TURBINE WITH ROTORS GEARED TOGETHER

This application is a continuation-in-part of the application of Clyde F. Berry, Ser. No. 866,491 filed Jan. 3, 1978, now abandoned, for Turbine with Rotors Geared Together.

BACKGROUND OF THE INVENTION

In the steam turbine art, there may be a single rotor with peripheral vanes against which the steam, entering the housing in a tangential direction, is directed. Where there are a plurality of rotors, they are customarily secured in spaced relation along a common shaft with stationary steam reversing blades therebetween. The steam is thus directed successively to all of the rotors to make maximum use of the available energy.

As far as I am aware, the prior art does not disclose the practice of directing one or two sources of steam simultaneously and tangentially at the vanes of two closely adjacent rotors in which one rotor is mounted directly on the turbine shaft and the other rotor is connected to the shaft by gearing. Further, the prior art does not disclose two side by side rotors running at different speeds in which the vanes on the rotors and housing are so arranged that the rotors are driven by both the kinetic energy of the steam against the vanes and the subsequent expanding force of the steam acting against the vanes.

SUMMARY OF THE INVENTION

The invention herein disclosed contemplates the use in a turbine of a compressible driving fluid, preferably steam, although it could be any other suitable compressed gas, in a manner to derive the maximum power therefrom. This is accomplished by first using the kinetic energy of the steam as it strikes the vanes of adjacent rotors and secondly, by using the expanding force of the steam directed oppositely disposed vanes.

To accomplish the foregoing, the invention requires the use of at least two side by side rotors mounted in a common housing. One rotor is mounted on and keyed to the turbine shaft. The other rotor also mounted on the same shaft, but keyed to a floating sleeve surrounding the shaft is connected thereto by exterior gearing. The preferred design has the gearing so arranged that the rotor keyed directly to the shaft rotates faster than the gearing-connected rotor, but this situation could be contraposed. That is to say, the gearing can be so arranged that the rotor that is keyed directly to the shaft will rotate slower than the gearing connected rotor. Both rotors rotate in the same direction however. The faster rotor whether it be the rotor that is keyed to the shaft or the gearing connected rotor is hereinafter called the "leading" rotor. The slower rotor is called the "lagging" rotor.

For convenience in subsequent explanation, the driving fluid utilized in the turbine will be steam. The steam nozzle or nozzles direct the steam against the vanes of the rotors to set the turbine in operation. The lagging rotor rotates at a slower speed than the leading rotor. The difference in speed is determined by the gears connecting the lagging rotor to the shaft.

In a preferred arrangement, the incoming steam is directed by a first nozzle or nozzles against the vanes of the leading rotor and by a second nozzle or nozzles against the exterior forward-motion vanes on the lagging rotor.

The lagging rotor carries on its interior, a second set of vanes closely adjacent the vanes of the leading rotor. As the steam from the first nozzle or nozzles expands between the leading rotor vanes and the adjacent vanes of the lagging rotor, the resulting forward driving force is applied to the leading rotor.

The housing carries a set of fixed vanes which are closely adjacent the exterior set of vanes on the lagging rotor. As the steam from the second nozzle or nozzles expands between the lagging rotor's exterior set of vanes and the fixed vanes on the housing, the resulting forward driving force is applied to the lagging rotor.

In a modification of the invention, mean is provided in the form of diagonal ports extending from the interior to the exterior of lagging rotor whereby some of the higher pressure steam that has acted on the vanes of the leading rotor and the interior vanes on the lagging rotor, may flow diagonally outward and backward through the body of the lagging rotor to engage the fixed vanes on the interior of the housing.

The net effect of these constructions hereinafter described in detail and set forth in the claims is to produce greater horsepower output from the available steam.

In the accompanying drawings

FIG. 5 shows a sectional view of a modification in which the lagging rotor has diagonal steam ports extending therethrough.

FIG. 6 is an enlarged fragmentary section taken on the line 6—6 of FIG. 5.

FIG. 7 is a fragmentary interior view of the fixed vanes that are mounted about the circular interior of the housing.

FIG. 8 is another modification similar in principle to FIG. 5 but with the lagging rotor of increased radius to provide a greater lever arm for the steam to act against.

FIG. 9 is an enlarged fragmentary section taken on the line 9—9 of FIG. 8.

DETAILED DESCRIPTION OF A PREFERRED EMBODIMENT

Figure 1:
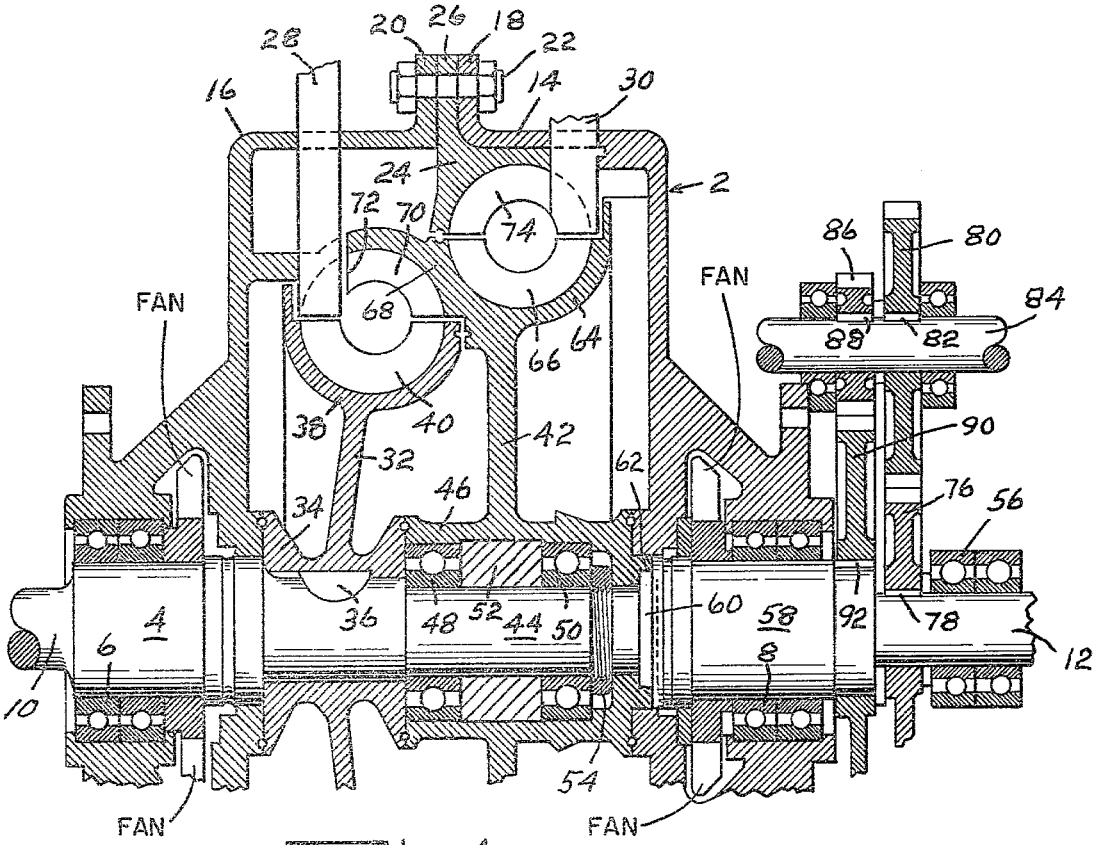
FIG. 1 shows in vertical section a preferred form of the invention utilizing two steam nozzles, one directed at the leading rotor and the other at the lagging rotor.

In FIG. 1 is shown a preferred embodiment of the invention. In this view, which is a vertical section, the lower halves of the rotors being identical with the upper halves, have been omitted to permit the drawing to be made to a larger scale.

A turbine housing, generally referred to at 2 supports a rotatable shaft 4. The shaft 4 is carried by conventional bearings 6 and 8 mounted in the ends of the housing. One end of the shaft as at 10 may be connected with a conventional governor (not shown) that will control the steam supply and the turbine's speed.

The other end of shaft 4 as at 12 may be coupled to the shaft of an electric generator (not shown) or any other machine which the turbine is to drive.

The housing 2 is made in two parts 14 and 16 whose flanges 18 and 20 are bolted together by bolts 22. A circular element 24 whose significance will shortly be explained has a flange 26 which is bolted between flanges 18 and 20 to form a steam tight joint all around the housing.

A first nozzle for introducing live steam into the housing is shown at 28 and a second live steam nozzle is shown at 30. It will be understood that the nozzles are arranged to pass through the housing in directions which will cause each to deliver its steam substantially tangentially of the rotor to which it is related. This will be better understood as the description proceeds.

A first rotor 32 having a hub 34 is mounted on shaft 4 and keyed thereto by a key 36. The outer part of the rotor is as shown generally semi-circular in cross section as at 38. A large number of crosswise extending vanes, one of which is shown at 40, have been milled into the outer periphery of rotor 32. The vanes are the shape shown because of the convenience of creating them through the use of a circular milling cutter. It should, however, be understood that the shape of the vanes may be varied without changing the nature of the operation of the turbine. It will also be understood that when the term vanes is used in the claims, it contemplates any kind or shape of vane or blade that will perform satisfactorily in a steam turbine.

A second rotor 42 is also mounted on that part of shaft 4 indicated at 44 adjacent rotor 32. This second rotor, however, has its hub 46 carried by bearings 48 and 50 so that rotor 42 is rotatable with respect to shaft part 44. A spacer 52 maintains the bearings 48 and 50 in proper position.

A nut 54 threaded on a reduced diameter part of shaft 4 holds the hubs 34 and 46 and bearings 48 and 50 in proper position on shaft 4. There is suitable rotating clearance between the hubs and the housing and between the hubs themselves.

Shaft 4 has an extended portion 12 previously referred to of somewhat reduced diameter. This extension is adapted to be coupled to the shaft of a driven machine such as a generator (not shown). The outer end of shaft portion 12 is supported by bearings 56 carried by any suitable supporting structure.

Between shaft portion 12 and the bearings 8 is a full floating power transmission sleeve 58. This sleeve at its left end is connected with hub 46 of rotor 42 by means of a square end 60 fitting within a corresponding square cavity 62 in the end of hub 46. In this way, rotation of rotor 42 causes rotation of sleeve 58 as the parts are directly connected.

From the description thus far it will be seen that rotor 32 is fixed to shaft 4 but rotor 42 and sleeve 58 are free to revolve on shaft 4.

The peripheral parts of rotor 42 will now be described. A first semi-cylindrical rim 64 extends around the rotor 42. A plurality of crosswise extending preferably evenly spaced vanes 66 similar to vanes 40 are supported by rim 64.

Rim 64 has connected thereto a reversely turned cylindrical rim 68 extending to the left. This rim surrounds the outer part 38 and vanes 40 of rotor 32. Rim 68 carries in its concave interior a plurality of crosswise extending vanes 70 which are radially aligned with vanes 40. These vanes 70 and the supporting rim terminate at 72 so as not to interfere with steam nozzle 28 during rotation about shaft 4.

From the foregoing description it will be understood that rotor 32 carries a single set of vanes 40 about its perimeter while rotor 42 carries two sets of vanes 66 and 70 so arranged that vanes 70 overlie vanes 40 and vanes 66 are located within a fourth set of vanes 74 mounted interiorly on the circular element 24 previously referred to.

Steam from nozzle 28 impinges on vanes 40 causing rotor 32 and shaft 4 to rotate. Steam from nozzle 30 impinges on vanes 66 causing rotor 42 and sleeve 58 to rotate on shaft part 44 and extension 12 of shaft 4.

In FIG. 1, the vanes 66 are more radially distant from shaft 4 than vanes 70 but are not shown as being in radial alignment with vanes 70. It is to be understood however that the disclosures of FIGS. 3 and 5 which are illustrative of arrangements in which the four sets of vanes are progressively more radially distant from the shaft and also radially aligned, show how the vanes 66 and 74 of FIG. 1 could be shifted to the left to be radially aligned with vanes 40 and 70. FIG. 1 is therefore to be considered the equivalent of FIGS. 3 and 5 as to the disposition of the vanes.

GEARING FOR CONNECTING ROTORS

In the following description, the means for connecting the rotors by gears will be explained. The arrangement as specifically shown in the drawings is such that rotor 32 will rotate faster than rotor 42 at a predetermined uniform differential but as pointed out above, it may be considered desirable to have the rotor that is keyed to the shaft rotate slower than the gearing connected rotor. Obvious changes in the number of teeth on the gears will accomplish this result.

Now referring to the accompanying drawings, a gear 76 is keyed to extension 12 at 78. Gear 76 drives gear 80 keyed at 82 to counter shaft 84. A third gear 86 smaller than gear 80 and also keyed at 88 to the counter shaft drives a fourth gear 90 larger than gear 76 and keyed at 92 to sleeve 58.

By the gearing just described, rotor 32 is now positively connected to rotor 42. Rotor 32 in the preferred form will always rotate faster than rotor 42. The ratio of speeds of rotation is controlled by the sizes of the gears. The ratio may be varied if desired.

OPERATION OF FIG. 1 CONSTRUCTION

The housing 2 has two steam nozzles 28 and 30 directed tangentially at vanes 40 and 66 respectively. The construction as shown utilizing close clearances keeps the steam paths apart. There are of course steam exhausts (not shown) for both steam supplies.

Both steam supplies are turned on causing both rotors 32 and 42 to commence rotation in the same direction with rotor 32 rotating faster than rotor 42.

Rotor 32 as previously explained is the "leading" rotor and rotor 42 is the "lagging" rotor.

The available steam is utilized in two ways. The kinetic energy applies a direct force to vanes 40 and 66 causing rotation thereof. After the rotors are in rotation, it will be appreciated that vanes 40 on the leading rotor are advancing with respect to vanes 70 on the lagging rotor. Likewise vanes 66 on the lagging rotor are advancing with respect to the fixed vanes 74 attached to the housing. The steam after expending its kinetic energy against vanes 40 and 66 is then, while on its way to the exhaust ports, capable of expanding to apply a forward force against vanes 40 and 66 and a rearwood force against the slower moving vanes 70 on rotor 42 and the fixed vanes 74 on the housing.

The net effect of the expansion of the steam in the constantly expanding spaces between the respective sets of vanes is to extract more work from the steam with a resulting increase in horsepower output from shaft 4.

Figure 2:
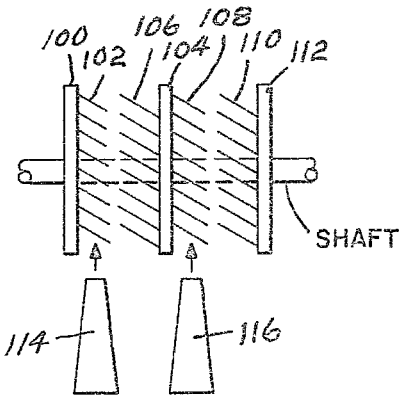
FIG. 2 is a schematic showing of a modification in which the vanes on the lagging rotor are located axially between the vanes of the leading rotor and the fixed vanes on the housing.

In the modification shown in FIG. 2 there is a leading rotor 100 having vanes 102. Along side rotor 100 is lagging rotor 104 having a first set of vanes 106 along side vanes 102 and a second set of vanes 108 along side fixed vanes 110 mounted on the housing 112. Two steam nozzles 114 and 116 are used. Rotors 100 and 104 are geared together in the manner previously explained. The basic distinction in this arrangement is that there are four sets of vanes all side by side at equal radial distances from the shaft.

Figure 3:
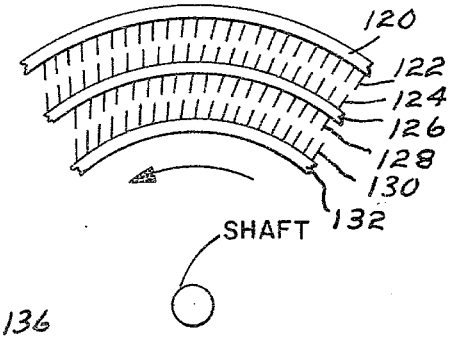
FIG. 3 is a schematic view of an arrangement basically the same as FIG. 1 but having the four sets of vanes in more exact radial alignment.

FIG. 3 differs from FIGS. 1 and 2 in that the vanes are concentrically arranged and aligned. The housing 120 carries interior vanes 122 which surround exterior vanes 124 on lagging rotor 126. Interior vanes 128 on lagging rotor 126 surround vanes 130 on the exterior of leading rotor 132. Steam is supplied by two nozzles (not shown) and directed at vanes 130 of the leading rotor 132 and at the vanes 124 of the lagging rotor 126 to cause rotation in the direction of the arrow. Leading and lagging rotors 132 and 126 are geared together in the manner previously explained.

Figure 4:
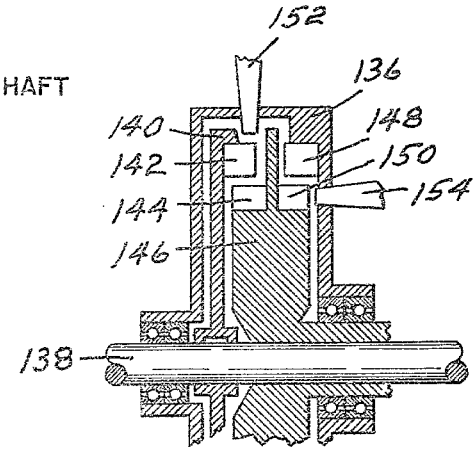
FIG. 4 is a vertical section to small scale of a modification in which the lagging rotor vanes are surrounded by the leading rotor vanes and the fixed housing vanes.

The construction shown in FIG. 4 differs from the construction shown in FIG. 1, in that both sets of vanes on the lagging rotor are within the confines of the vanes on the leading rotor and the fixed vanes on the housing.

Housing 136 has a shaft 138 on which is fixed leading rotor 140. Leading rotor 140 has vanes 142 which surround vanes 144 on lagging rotor 146. Fixed vanes 148 on the housing surround the second set of vanes 150 on the lagging rotor 146. Steam is admitted through nozzle 152 to impinge on vanes 142 while steam entering through nozzle 154 impinges on vanes 150.

Leading rotor 140 and lagging rotor 146 are connected in the previously described manner by the gearing (not shown).

Referring now to FIGS. 5, 6 and 7. The housing 160 has a shaft 162 suitably mounted on bearings 164 and 166.

The leading rotor 168 is keyed to shaft 162 by key 170. Vanes 172 extend in spaced relation about the periphery of rotor 168. Steam nozzle 174 enters the housing to direct steam substantially tangentially against vanes 172 to drive shaft 162 in the direction of the arrow on the shaft.

The lagging rotor 176 is mounted on and keyed to sleeve 178 by key 180. Sleeve 178 which is rotatable on shaft 162 carries a keyed gear 182 which meshes with gear 183 keyed to counter shaft 184 suitably supported by bearings 186. Another gear 188 keyed to counter shaft 184 meshes with gear 190 keyed to shaft 162. By means of the foregoing gearing, rotors 168 and 176 are positively connected to rotate at relative speeds determined by the gear ratios.

Rotor 176 has a short cylindrical peripheral portion 192 carrying interior vanes 194 and exterior vanes 196. These vanes 196 shown in FIGS. 5 and 6 are preferably in the form of cylindrical holes drilled at uniform intervals diagonally into the periphery of cylindrical portion 192. The vanes could also be in the form of any equivalent structure such as milled pockets for example. Steam nozzle 198 is positioned to direct steam against vanes 196 to cause rotation of rotor 176 in the direction of the arrow but at a peed in relation to rotor 168 determined by the gearing.

The interior vanes 194 closely surround vanes 172 of rotor 168. The exterior of cylindrical portion 192 is closely adjacent the vanes 200 which are fixed to the circular interior of housing 160. Vanes 200 are in the form of short square pins arising from the interior circular surface of housing 160. These pins have proven to be effective as steam engaging means.

FIGS. 5 and 6 disclose a modified construction not found in FIGS. 1 to 4. As best seen in FIG. 6, there are diagonal ports 202 extending from the apex of every other vane 194 outwardly and rearwardly through the cylindrical portion 192 of lagging rotor 176. In FIG. 5 it can be seen that there are two rows of ports 202 with the vanes 196 intermediate therebetween.

Thus in the operation of the turbine, steam is delivered from nozzle 174 to strike vanes 172 to put leading rotor 168 into rotation. Simultaneously steam from nozzle 198 strikes vanes 196 to put lagging rotor 176 into operation.

The steam from nozzle 174 initially applies its kinetic force to vanes 172. Thereafter, the steam expands to apply a forward force against vanes 172 and a backward force against the advancing but slower moving vanes 194 on the lagging rotor 176. In the meanwhile, steam from nozzle 198 initially applies a forward force against vanes 196 and thereafter as the steam expands, a backward force is applied against the fixed vanes 200.

The ports 202 provide passages through which steam may travel in either direction depending upon the relative pressures in the space 204 between vanes 172 and 194 and in the space 206 between vanes 196 and 200. If the pressure is greater in space 204 than in space 206 which is the preferred condition, steam will flow outwardly to impinge on vanes 200.

Still another species is shown in FIGS. 8 and 9. This construction is in general similar to the construction of FIG. 5. There is a housing 220, a leading rotor 222 and a lagging rotor 224 both mounted on shaft 225 and connected by gearing 226 whereby the leading rotor 222 rotates faster than the lagging rotor 224.

Steam nozzle 228 delivers steam against vanes 230 and nozzle 232 delivers steam against vanes 234. Rotor 224 has a circular flange-like extension 236 which extends over the vanes 230 of rotor 222. Extension 236 includes vanes 238 on its inner side in close relation with vanes 230.

Extension 236 also includes two rows of diagonal ports 240 (see FIG. 9). Surrounding the outer side of extension 236 are the fixed circumferential vanes 242. Surrounding vanes 234 are the fixed vanes 244. It will also be noted that the lever arm of rotor 224 is substantially longer than the lever arm of rotor 222 thereby to improve the leverage of the steam from nozzle 232 against rotor 224.

Expanding steam from nozzle 228 acts against vanes 230 of rotor 222 and against vanes 238 or rotor 224 and part of the steam flows outward through ports 240 to act against fixed vanes 242.

In brief summary of all of the foregoing, the turbine housing contains at least two rotors mounted on the turbine shaft. One rotor is connected directly to the shaft, the other rotor being connected to the shaft by intermediate gearing whereby the rotors must rotate at unequal speeds. Both rotors carry vanes or the equivalent thereof. The incoming steam from the two nozzles drives the rotors first by striking the vanes directly and thereafter by expansion of the steam acting on the relatively advancing and receding vanes of the leading and lagging rotors respectively.

In the species shown in FIGS. 5 to 9, the lagging rotor includes diagonal ports extending through a circular flange-like portion thereof through which steam flows outwardly to engage the fixed vanes on the housing.

The above disclosure will suggest to others skilled in the art modifications which are within the scope of the invention as defined by the appended claims.

I claim:

1. A steam turbine comprising a housing, a shaft carried by said housing, a first rotor mounted on and fixed to said shaft, steam engaging vanes arranged about the outer circumference of said first rotor, a second rotor mounted on said shaft adjacent said first rotor, means connecting said shaft with said second rotor including gearing exterior of said housing whereby when said first rotor is rotated said second rotor will rotate in the same direction at a speed different than that of said first rotor, said second rotor having a first set of vanes arranged radially beyond and radially aligned with and closely adjacent the steam engaging vanes on said first rotor, said housing having a set of fixed circularly arranged vanes, said second rotor having a second set of vanes positioned radially beyond said first set of vanes on said second rotor and radially aligned with the fixed vanes on said housing, a first steam nozzle for directing steam substantially tangentially against the vanes of said first rotor to cause rotation thereof and whereby the steam from said first nozzle on expanding will provide forward thrust against the vanes of said first rotor and rearward thrust against the said first set of vanes of said second rotor, and a second steam nozzle for directing steam substantially tangentially against the said second set of vanes of said second rotor to cause rotation thereof and whereby the steam from said second nozzle on expanding will provide forward thrust against the said second set of vanes of said second rotor and rearward thrust against the fixed vanes on said housing.

2. The turbine set forth in claim 1, said second rotor including two rows of ports circularly arranged, the outer ends of said ports being axially spaced from the second set of vanes on said second rotor.

3. The turbine set forth in claim 1, said second rotor including a plurality of ports therethrough extending from the interior to the exterior thereof, said ports having their inner ends opposite the said vanes of said first rotor and their outer ends opposite fixed vanes on said housing.

4. The turbine set forth in claim 3, said ports extending diagonally outwardly and rearwardly.

5. The turbine set forth in claim 3, the radius of said second rotor being substantially greater than the radius of said first rotor, the fixed vanes on said housing that are opposite the outer ends of said ports being located radially inwardly of the outer periphery of said second rotor and another set of vanes fixed to said housing that are opposite the second set of vanes on said second rotor.

6. A steam turbine comprising a housing, a shaft carried by said housing, a first rotor mounted on and fixed to said shaft, steam engaging vanes arranged about the outer circumference of said first rotor, a second rotor mounted on said shaft adjacent said first rotor, means connecting said shaft with said second rotor including gearing exterior of said housing whereby when said first rotor is rotated said second rotor will rotate in the same direction at a speed different than that of said first rotor, said housing having a set of fixed vanes circularly arranged and radially aligned with the vanes on said first rotor, part of said second rotor being in the form of a short circular portion extending axially between the vanes of said first rotor and said housing, said circular portion having vanes on its interior radially opposite the vanes on said first rotor and having vanes on its exterior radially aligned with the vanes on said housing, a first steam nozzle for directing steam substantially tangentially against the vanes of said first rotor to cause rotation thereof and whereby the steam from said first nozzle on expanding will provide forward thrust against the vanes of said first rotor and rearward thrust against the interior vanes of said second rotor, and a second steam nozzle for directing steam substantially tangentially against the exterior vanes of said second rotor to cause rotation thereof and whereby the steam from said second nozzle on expanding will provide forward thrust against the exterior vanes of said second rotor and rearward thrust against the fixed vanes on said housing.

7. The turbine set forth in claim 6, and a plurality of circularly aligned diagonal ports extending through said short circular portion.

8. The turbine set forth in claim 7, the exterior vanes on said second rotor being in the form of a plurality of circularly aligned holes extending part way through said circular portion.

9. The turbine set forth in claim 8, said circular portion having at least one circularly arranged row of diagonal ports positioned in said circular portion adjacent the said holes.

10. The turbine set forth in claim 8, said circular portion having two circular rows of diagonal ports extending therethrough and said holes being in a circular row between said rows of ports.

* * * * *